United States Patent [19]

Jochmann

[11] 4,019,296

[45] Apr. 26, 1977

[54] FACADE CLAD BUILDINGS AND METHOD

[75] Inventor: Ludwig V. Jochmann, Wadenswil, Switzerland

[73] Assignee: The Dow Chemical Company, Midland, Mich.

[22] Filed: Dec. 12, 1975

[21] Appl. No.: 640,130

[52] U.S. Cl. ..... 52/268; 52/303; 52/309.9; 52/407; 52/410; 52/747

[51] Int. Cl.[2] ..... E04B 2/28

[58] Field of Search ..... 52/267–269, 52/515, 309, 516, 622, 408, 407, 410–413, 404–406, 479, 302, 303, 533, 747

[56] References Cited

UNITED STATES PATENTS

| | | | |
|---|---|---|---|
| 2,012,070 | 8/1935 | Hohl | 52/479 |
| 3,019,864 | 2/1962 | Lester | 52/405 X |
| 3,362,120 | 1/1968 | Warren | 52/309 |
| 3,378,975 | 4/1968 | Hill | 52/404 X |
| 3,387,422 | 6/1968 | Wanzer | 52/410 X |
| 3,411,256 | 11/1968 | Best | 52/408 |
| 3,476,912 | 11/1969 | Garrison | 52/410 X |
| 3,545,153 | 12/1970 | Bach et al. | 52/407 |
| 3,561,183 | 2/1971 | Keener | 52/269 X |
| 3,676,198 | 7/1972 | McGroarty | 52/515 X |
| 3,763,614 | 10/1973 | Hyte et al. | 52/408 X |
| 3,772,840 | 11/1973 | Hala | 52/303 |
| 3,881,288 | 5/1975 | Fay | 52/408 X |
| 3,888,055 | 6/1975 | Gallo | 52/747 X |
| 3,898,780 | 8/1975 | Beer | 52/410 |

FOREIGN PATENTS OR APPLICATIONS

| | | | |
|---|---|---|---|
| V 5,940 | 12/1956 | Germany | 52/404 |
| 248,327 | 9/1962 | Australia | 52/410 |
| 1,288,314 | 9/1972 | United Kingdom | 52/516 |

*Primary Examiner*—Leslie Braun
*Attorney, Agent, or Firm*—Robert B. Ingraham

[57] ABSTRACT

Buildings are clad with facade panels by applying a generally moisture-impermeable layer to the exterior wall, applying a layer of a closed-cell water-impermeable insulating foam to the water-impermeable layer suspending facade cladding pane in spaced relationship to the foamed insulation. It is not necessary to seal or otherwise waterproof the joints between the facade cladding panels.

9 Claims, 2 Drawing Figures

FACADE CLAD BUILDINGS AND METHOD

Figure 1:
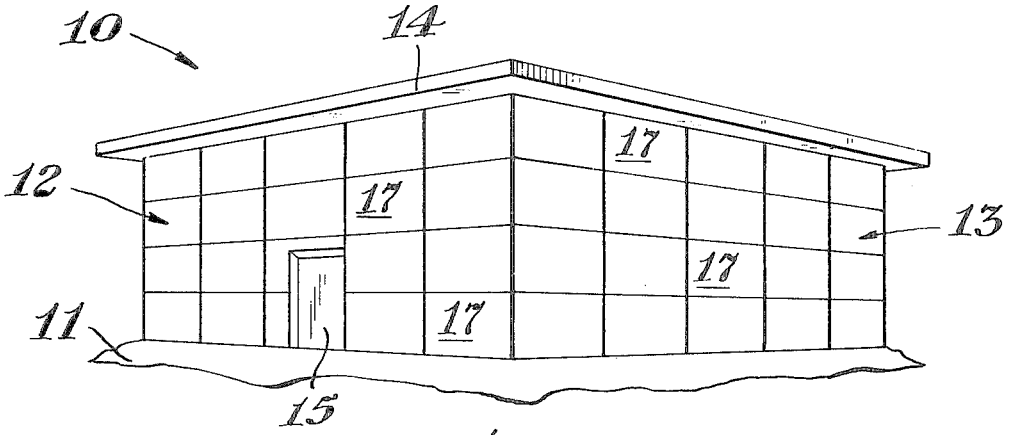

In many instances it is desirable from both a utilitarian and aesthetic standpoint to construct buildings using facade cladded panels as the external surface on the vertical walls. In conventional construction techniques, particularly in the temperate climates, often thermal insulation is disposed between the building wall and the facade cladding panels which are suspended or supported in spaced relationship to the wall. Joints between the facade cladding panels are then sealed to prevent the passage of water between adjacent panels into the thermal insulating material disposed behind the panels. Such a method of construction usually requires substantial labor and extreme care in providing a waterproof seal between the facade cladding panels. Once such panels have been installed and sealed, they are subject to expansion and contraction caused by changes in ambient temperatures both on a daily basis and on a seasonal basis. Such expansion and contraction or thermal working of the panels and sealant can cause failure in the joint between adjacent panels at some undetermined future time. The joints between the facade panels provide the principal water seal which protects the building. A failure of such a seal permits entry of water into the thermal insulation disposed in the space between the wall of the building and the facade cladding panel. In the event that certain insulating materials are employed such as thermal insulating materials using fibrous materials such as organic and inorganic fibers such as mineral fibers, glass wool, water-sensitive plastic foam insulation and the like, a substantial loss in insulating valve occurs when such materials become wet.

It would be desirable if there were available an improved method for the facing of a thermally insulatd structure employing facade cladding panels.

It would be desirable if there were available an improved method for the fabrication of facade cladding panel faced thermally insulated building structures wherein it was unnecessary to provide a water or moisture seal between adjacent cladding panels.

It would also be desirable if there were available an improved building structure which was thermally insulated and had facade cladding panel facing wherein the panels were not required to have a water tight seal between adjacent edges.

These benefits and other advantages in accordance with the present invention are achieved in a building structure, the building structure having a wall and a roof, the wall and roof enclosing a useful space therein, the wall having an exterior surface, the exterior surface having a generally water-impermeable layer affixed thereto, the water-impermeable layer being generally coextensive with the outer surface of the wall, a layer of thermal insulation disposed on the water-impermeable layer and affixed thereto, the layer of thermal insulation comprising a closed-cell, generally water-impermeable foam, a plurality of facade cladding panels disposed remote from the water-impermeable layer and generally adjacent the closed-cell foam thermally insulating layer and means to suspend the panels in generally spaced parallel relationship to an adjacent surface of the foam insulating layer, and at least a majority of the panels defining between adjacent edges a water-permeable passage.

Alsio contemplated within the scope of the present invention is a method for the facade cladding of a structure, the steps of the method comprising applying to at least a major portion of an external wall surface of a building a generally water-impermeable layer, disposing on the water-impermeable layer a thermal insulating layer, the thermal insulating layer being of a closed-cell, water-impermeable thermal insulating material, disposing adjacent the thermally insulating layer a plurality of facade cladding panels in generally edge-to-edge relationship wherein between adjacent edges of at least a majority of the panels a water-permeable channel is formed, the plurality of facade cladding panels being adjacent the foam insulation and remote from the wall, the panels being suspended in generally spaced parallel relationship to the foam insulation and maintaining the facade cladding panels in generally fixed spaced relationship from the foam insulation.

Further features and advantages of the present invention will become more apparent from the following specification taken in connection with the drawing wherein:

FIG. 1 schematically depicts a building or structure in accordance with the present invention.

Figure 2:
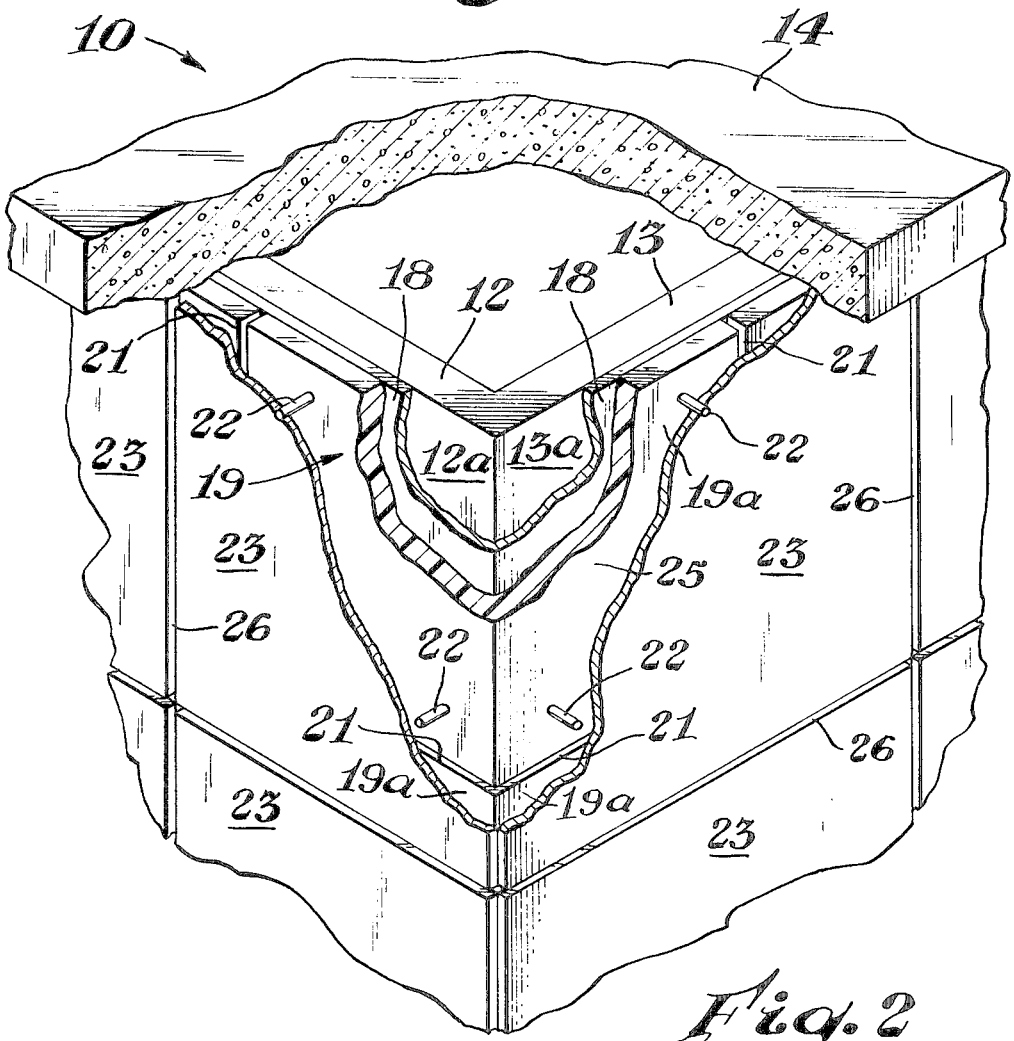

FIG. 2 is a schematic cut-away representation of a portion of the building depicted in FIG. 1.

In FIG. 1 there is schematically depicted a building or structure in accordance with the present invention generally designated by the reference numeral 10. The building 10 comprises a base 11, two walls 12 and 13 and a remaining two walls not shown. Disposed above the two walls 12 and 12 and the two walls not shown and is a roof 14. A doorway 15 is formed in the wall 12, a plurality of facade cladding panels 17 are disposed on the exposed surfaces of the walls 12 and 13 and the two walls not shown.

In FIG. 2 there is depicted a fractional schematic cut-away view of the building 10 showing the uppermost juncture of the first wall 12, the second wall 13 and the roof 14. The walls 12 and 13 define exterior wall surfaces **12*a* and 13*a* respectively. Disposed on surface 12*a* of the wall 12 is a water-impermeable membrane 18, the membrane 18 extends also over the surface 13*a* and to the surfaces of the walls of the building not shown. Immediately adjacent the membrane 18 and remote from the surface 12*a* of the wall 12 is a layer of thermal insulation generally designated by the reference numeral 19. The layer 19 comprises a plurality of panels 19*a* which define therebetween adjacent edges a plurality of water-permeable channels 21. The panels 19*a* forming the layer 19 are disposed in edge-to-edge relationship. The channels 21 provide communication between space remote from the membrane 18 and the surface of the membrane 18 adjacent the panels 19*a*. A plurality of support means or studs 22 extend through layer 19, membrane 18 and are generally rigidly affixed to the walls of the structure such as walls 12 and 13. The studs 22 extend outwardly from the walls beyond the layer 19. A plurality of facade cladding panels 23 are disposed in fixed, spaced, generally parallel relationship with the layer 19. The layer 19 and the panels 23 define therebetween a space 25. The studs 22 are connected to the panels 23 by any convenient means commonly employed to attach facade panels. The edges of the panels 23 define therebetween a plurality of passageways 26. The passageways 26** are water permeable.

A wide variety of materials may be employed in the fabrication of structures in accordance with the present invention. The walls may be of any material suitable for the fabrication of walls, such as brick, concrete blocks, cast concrete slabs, wood including plywood, hardboard, chipboard or like materials suitable for the particular application. The water-impermeable membrane may comprise or consist of a wide variety of water-impermeable materials including asphaltic and bituminous compositions alone or in combination with fibrous reinforcing materials such as roofing felt employing organic or inorganic fibers. In certain instances, the water-impermeable membrane can be formed of synthetic thermoplastic resinous film or sheet such as polyethylene, polyvinylchloride and the like. The film or sheet may be adhered to the wall by a suitable adhesive or stapled thereto. The water-impermeable membrane may be a continuous membrane or may be applied as a plurality of laterally extending strips wherein the lower edge of each successive higher tip overlaps the upper edge of the adjacent lower strip wherein the upper edge of the lower strip is disposed generally adjacent the wall and the lower edge of the upper strip is remote from the wall. Alternatively, the water-impermeable membrane may be of a continuous synthetic nature such as is obtained by placing a liquid curable, hardenable composition on the wall and causing it it cure into a continuous water-impermeable layer. One of the more popular varieties of such coatings is a polyurethane composition. Suitable water-impermeable membrane may also be prepared employing overlapped sheet of the material such as sheet metal and the like.

The thermal insulating layer suitable for the practice of the present invention beneficially is a closed cellular material which is substantially water-impermeable, that is, it does not absorb or hold substantial quantities of water within its cells. Particularly beneficial and advantageous in the present invention of cellular plastic foams of the closed-cell configuration include styrene polymer foams, styrene-acrylonitrile copolymer forms, styrene-methylmethacrylate copolymer foams and styrene-maleic anhydride copolymer foams preferably containing less than about 30 weight percent maleic anhydride copolymerized therein, polyvinyl chloride foams, polyethylene foams and other water-impermeable materials available in cellular form which are well-known to the art. Foamed glass is particularly advantageous if the facade cladding panels are spaced apart in such a manner that substantial exposure of the foam to sunlight will occur. Polyurethane foams are also usable in applications where excessive moisture is not encountered. When organic foams are employed and substantial exposure to sunlight will occur, it is usually desirable to coat the exposed surface of the foam with a material resistant to sunlight. A variety of materials may be employed as a sunlight resistant coating including organic latex compositions containing a high proportion of inorganic pigment. A thin layer of mortar may be employed as a protective layer and is convenient when the foam surface is of the so-called cut-cell variety, that is closed-cell foam wherein the exposed surface has been formed by slicing through the body of the foam. The exposed surface consists primarily of partial or open cell into which the mortar may flow, harden and provide a mechanical lock between the foam and the hardened mortar. The foam or thermal insulating layer is attached to the wall over the water-impermeable layer by an appropriate adhesive or by the cladding panel supports. The precise means of attachment will vary depending upon the selection of the water-impermeable layer. It the water-impermeable layer is affixed to the wall over its entire surface such as a hardened polyurethane composition which was initially painted or otherwise spread onto the surface of the wall before hardening and the membrane adheres well to the wall, the foam insulation may be adhesively bonded to the water-impermeable membrane. In the event that the water-barrier layer is a material such as polyethylene and is held to the wall by stapling, the foam desirably is connected to the wall by nails, bolts, studs, screws or like mechanical connectors. If maximum water resistance of the water-impermeable membrane is required, it is generally desirable to apply a sealant to the mechanical fasteners at the locations where they pass through the water-impermeable membrane. In applying the foamed insulation, it is not necessary that each foam insulating membrane be in edge-to-edge sealing engagement and narrow spaces such as may result from manufacturing tolerances may be left between adjacent foam insulating sheets or panels without causing a significant loss of insulating value.

In many instances, it is desirable that a visible crack or channel be defined between adjacent panels. If the wall is subjected to significant quantities of rain, the crack or channel accelerates evaporation of any water which might find its way to the surface of the water-barrier membrane and provide a drainage route for any water entering in the spaces between the facade cladding panels. In general such a channel should be as small or narrow as conventional construction practices and tolerances permit to minimize water entrance and heat loss.

Beneficially facade cladding panels are supported in generally fixed spaced relationship from the insulating layer. Beneficially such spacing is usually from about 2 millimeters to 3 or more centimeters and most advantageously from about 4 millimeters to 15 millimeters. Generally the narrower spacings are employed in drier climates and the greater spacings employed in wetter climates where increased air circulation is desired.

By way of further illustration, a building having an external surface of poured concrete was provided with facade cladding in accordance with the present invention by installing a number of facade cladding panel supporting bolts. The exterior surface was then coated with a commercially available hardenable-liquid composition which provided a water-impermeable membrane which adhered tightly to the concrete wall. Insulation was installed, the insulation was extruded closed-cell polystyrene foam panels. Most of the joints between adjacent foam panels showed a gap of no more than two millimeters and varied slightly. The facade cladding panels were then installed with a gap of about 2 millimeters between adjacent edges of adjacent panels and the panels spaced about one centimeter from the foam.

The resultant structure showed very satisfactory weather resistance without any need for sealing joints between the facade cladding panels or between the foam insulating members.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A building structure, the building structure having a wall and a roof, the wall and roof enclosing a useful space therein, the wall having an exterior surface, the exterior surface having a generally water-impermeable layer affixed thereto, the water-impermeable layer being generally coextensive with the outer surface of the wall, a layer of thermal insulation disposed on the water-impermeable layer and affixed thereto, the layer of thermal insulation comprising a closed-cell, generally water-impermeable foam, a plurality of facade cladding panels disposed remote from the water-impermeable layer and generally adjacent the closed-cell foam thermally insulating layer and means to suspend the panels in generally spaced parallel relationship to an adjacent surface of the foam insulating layer, and at least a majority of the panels defining between adjacent edges a water-permeable passage.

2. A building structure, the building structure having a wall and a roof, the wall and roof enclosing a useful space therein, the wall having an exterior surface, the exterior surface having a generally water-impermeable layer affixed thereto, the water-impermeable layer being generally coextensive with the outer surface of the wall, a layer of the thermal insulation disposed on the water-impermeable layer and affixed thereto, the layer of thermal insulation comprising a plurality of members of a closed-cell, generally water-impermeable foam, the members defining therebetween at adjacent edges thereof a plurality of channels into which a liquid may permeate, a plurality of facade cladding panels disposed remote from the water-impermeable layer and generally adjacent the closed-cell foam thermally insulating layer and means to suspend the panels in generally spaced parallel relationship to an adjacent surface of the foam insulating layer, and at least a majority of the panels defining between adjacent edges a water-permeable passage.

3. The structure of claim 2 wherein the water-impermeable membrane is a continuous membrane adhered to the surface of the wall.

4. The structure of claim 2 wherein the thermal insulation is a styrene polymer foam.

5. The structure of claim 3 wherein the thermal insulation is a closed-cell styrene polymer foam adhered to the water-impermeable membrane.

6. A method for the facade cladding of a structure, the steps of the method comprising applying to at least a major portion of an external wall surface of a building a generally water-impermeable layer, disposing on the water-impermeable layer a thermal insulating layer, the thermal insulating layer being of a closed-cell, water-impermeable thermal insulating material, disposing adjacent the thermally insulating layer a plurality of facade cladding panels in generally edge-to-edge relationship wherein between adjacent edges of at least a majority of the panels a water-permeable channel is formed, the plurality of facade cladding panels being adjacent the foam insulation and remote from the wall, the panels being suspended in generally spaced parallel relationship to the foam insulation and maintaining the facade cladding panels in generally fixed spaced relationship from the foam insulation.

7. A method for the facade cladding of a structure, the steps of the method comprising applying to at least a major portion of an external wall surface of a building a generally water-impermeable layer, disposing on the water-impermeable layer a plurality of the thermal insulating members, the thermal insulating members being affixed to the wall, the thermal insulating members being of a closed-cell, water-impermeable thermal insulating material, disposing adjacent thermally insulating materials in generally edge-to-edge relationship wherein between adjacent edges of at least a majority of the panels a water-permeable channel is formed, subsequently suspending the plurality of facade cladding panels adjacent the foam insulation and remote from the wall, the panels being suspended in generally spaced parallel relationship to the foam insulation and maintaining the facade cladding panels in generally fixed spaced relationship from the foam insulation, wherein adjacent edges of at least a majority of the panels define therebetween water-permeable passages.

8. The method of claim 7 wherein the water-impermeable layer is formed on the wall surface by applying a hardenable liquid to the surface of the wall.

9. The method of claim 7 including the step of adhering the foamed insulation to the water-impermeable layer.

* * * * *